United States Patent [19]

Howarth

[11] 4,409,474

[45] Oct. 11, 1983

[54] WIDERANGE PHOTOMULTIPLIER CIRCUIT

[75] Inventor: Robert F. Howarth, El Cajon, Calif.

[73] Assignee: The United States of America as represented by the Secretary of the Navy, Washington, D.C.

[21] Appl. No.: 268,203

[22] Filed: May 29, 1981

[51] Int. Cl.[3] ..... H01J 40/14

[52] U.S. Cl. ..... 250/207; 313/105 R

[58] Field of Search ..... 250/207, 213 VT; 313/103 R, 104, 105 R

[56] References Cited

U.S. PATENT DOCUMENTS 2,583,143 1/1952 Glick ..... 250/207

3,296,445 1/1967 Roos et al. ..... 250/207

*Primary Examiner*—David C. Nelms

*Attorney, Agent, or Firm*—Robert F. Beers; Ervin F. Johnston; Thomas Glenn Keough

[57] ABSTRACT

An improvement for a photomultiplier tube having its cathode, dynodes and anode spaced apart within an envelope increases the tube's linear dynamic range capability. A constant and stable collection potential is maintained between the anode and the dynode nearest the anode. In one form a zener diode voltage source and serially connected resistor are used or a fixed voltage is appropriately connected separate and distinct from the dynode potential connected across the other dynodes and the cathode. Thusly modified, a light flux range of approximately eight orders of magnitude can be accommodated by the improved photomultiplier tube circuitry.

10 Claims, 3 Drawing Figures

WIDERANGE PHOTOMULTIPLIER CIRCUIT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Photomultiplier tubes long have been used where changing light intensities are to be monitored. Sometimes the wide dynamic ranges of light flux can damage the tubes because of their high gain created self-destructive currents. Over the years a number of circuits have been developed for protecting photomultiplier tubes but for one reason or another they have disadvantages and limitations that make them unreliable or otherwise unacceptable.

The attenuation of incident optical light flux and the reduction of the dynode voltage are two methods most commonly used (alone and in combination) to accommodate the high-light-flux, large-anode-current region of a typical large dynamic range requirement characteristic of undersea optical receivers. These receivers have such a large dynamic range requirement to enable their functioning linearly from the sea surface in full daylight to great depths in partial moonlight. The dynamic range requirement spans approximately twelve orders of magnitude.

The conventional methods of protecting a photomultiplier tube operating over the wide dynamic range suffer from two shortcomings or limitations, namely, when optical attenuators are used they reduce the desired, often small optical signal (undesirable) as well as reducing the large ambient background light (desirable). Reduction of the dynode voltage is limited by the loss of anode collection efficiency and by the insufficient dynode bleeder (standby) currents at high collection current operation. If smaller dynode resistors are used to avoid this problem, the resultant high-wattage dissipation must be accepted and a much larger current capability and wattage from a variable voltage supply must be provided. Concommitant problems of space and power dissipation in a small confined package have deleterious effects on the optical receiver's linearity, stability and life.

Thus, there is a continuing need in the state-of-the-art for an apparatus and method for assuring a wide linear dynamic range capability for a photomultiplier tube that does not compromise its operational characteristics nor impose unreasonable power and packaging burdens.

SUMMARY OF THE INVENTION

The present invention is directed to providing an apparatus and method for increasing the linear dynamic range capability of a photomultiplier tube. A means is coupled between the anode and the dynode nearest the anode for impressing a constant and stable collection potential between them. The collection potential is separate and distinct from the dynode potential connected across the other dynodes and the cathode and, in one form, is a zener diode coupled across a voltage source having a resistor connected in series. Optionally, the voltage source can be a fixed voltage source that is in itself inherently stable and which is separate from the dynode potential.

The method includes the impressing of a constant and stable potential across the anode and the dynode nearest the anode irrespective of changing impinging light intensities so that sufficient anode current is provided.

It is the prime object of the invention to improve the operational characteristics of a photomultiplier tube.

Another object is to increase the linear dynamic range capability of a photomultiplier tube.

Still another object of the invention is to couple a constant and stable collection potential between the anode and the dynode nearest the anode to improve the operational capabilities.

Another object is to provide a method for impressing a constant and stable collection potential between a photomultiplier's anode and the dynode nearest the anode to increase its capabilities.

Another object is to provide an apparatus and method for increasing a photomultiplier's capabilities and protecting it while not overly adding to the complexity or cost of the photomultiplier circuit.

Yet another object is to extend the linear operation of a photomultiplier tube to include high light level inputs without requiring a larger, higher wattage dynode power supply than is required for lower light levels.

Still a further object is to provide an improved photomultiplier tube circuit that reduces the need for large optical attenuators to thereby minmize the attenuation of the optical signal.

Still another object is to provide for an improved photomultiplier tube circuit that reduces the power dissipation of the dynode resistor chain at high voltages.

Another object is to provide an apparatus and a method that maintains good collection potentials at both the anode and at the first dynode over the photomultiplier tube's entire range of operation.

Yet a further object is to provide an improvement for a photomultiplier tube that permits the use of a lower wattage, physically smaller dynode power supply in applications where space is limited.

Still a further object is to provide an improvement for a photomultiplier tube that employs a zener diode for maintaining the potential between the cathode and the first dynode. Another zener diode maintains the anode collection potential.

These and other objects, advantages and novel features of the invention will become apparent from the following detailed description of the invention when considered in conjunction with the accompanying drawings.

DESCRIPTION OF THE PREFERRED EMBODIMENT

Figure 1:
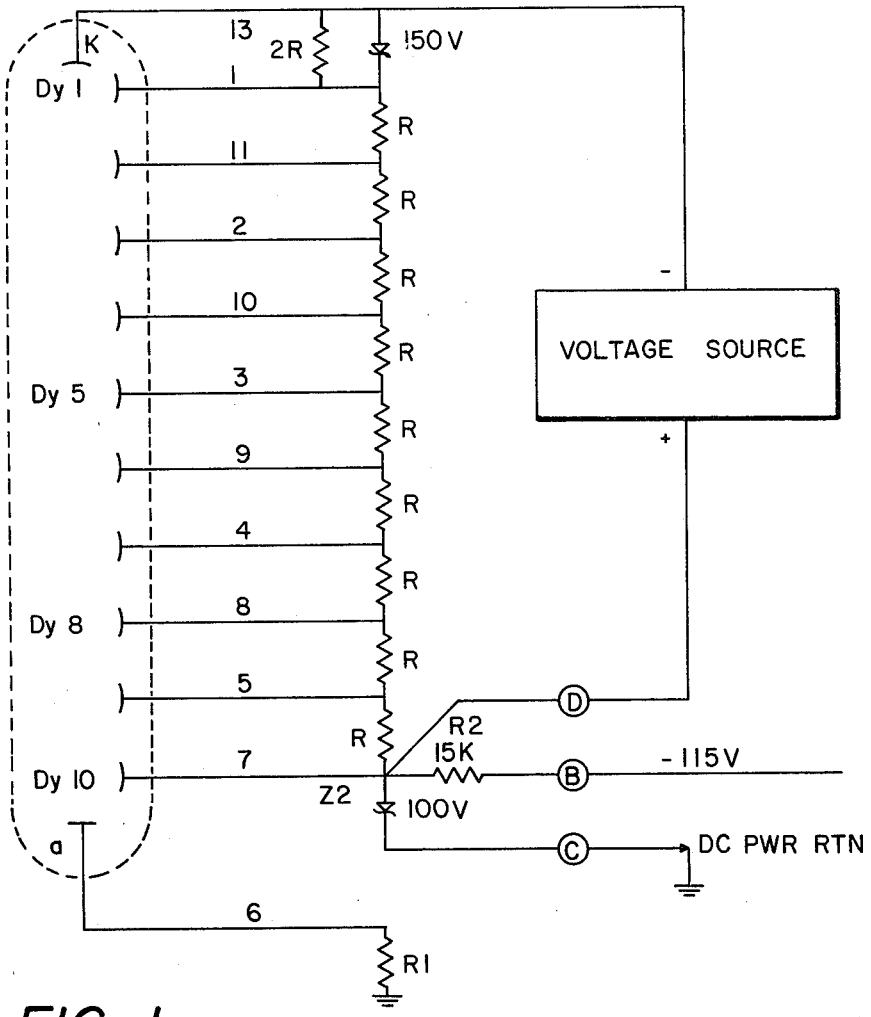
FIG. 1 is a schematic diagram of the improved apparatus of the invention.

Referring now to the drawings a representative photomultiplier tube shown in FIG. 1 has a number of dynodes 1–5 and 7–11 interconnected between a cathode 13 and an anode 6. All are contained within a protective envelope and have a voltage source coupled between the cathode at K and dynode 7. The voltage source has a potential of between −500 and −1400 volts with one milliamp maximum.

A resistor R of approximately 150 kilohms is coupled between adjacent dynodes. The resistors are selected to reduce the power dissapation at higher voltages.

A 150 volt avalanche breakdown zener diode is connected between dynode 1 and cathode 13. This zener diode is used to maintain the desired focus potential between the photocathode and the first dynode. This potential is held relatively constant over the large range of dynode voltage necessary to accommodate the desired range of light flux levels. As mentioned above, a typical voltage source has a magnitude from between −500 and −1400 volts with an approximate 1 milliamp current maximum to assure acceptable results with a number of commercially available tubes.

Figure 2:
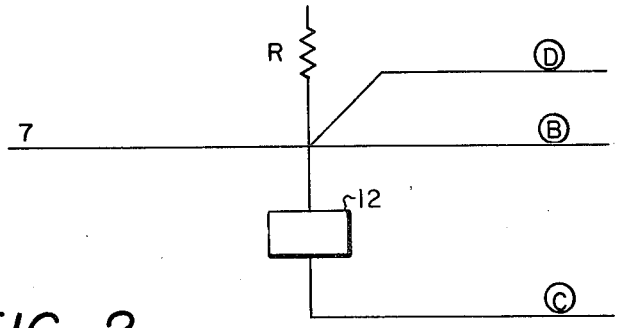
FIG. 2 shows a variation of the improvement of the invention.

A zener diode Z2 is connected between dynode 7 and ground which for purposes of this explanation can be considered the potential at which the anode is connected, or more simply stated, the anode itself. A separte voltage source of about −115 volts is connected between points B and C so that with the voltage drop across resistors R1 and R2, the reverse breakdown voltage of the zener diode creates a constant and stable 100 volt collection potential for the anode. This voltage source is separate and distinct from the voltage source coupled across the dynodes and cathode and supplies all of the electrons delivered to the anode collector. A resistor R2, approximately 15 kilohms, is serially connected to assure sufficient anode collector current. Optionally, zener diode Z2 and resistor R2 can be removed and stable external power source 12 can be connected directly between points B and C, see FIG. 2. However, this may unnecessarily complicate the external circuitry compared to the other approach.

As mentioned before the external potential source from R2 and Z2 or source 12 supplies all the electrons delivered to the anode collector. In general this current is sufficiently larger than the current available in the dynode chain when operating at the high light flux, low tube gain situation.

Figure 3:
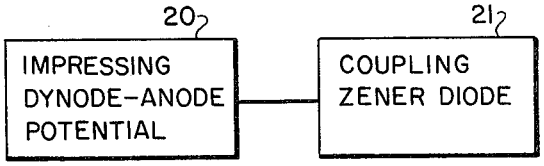
FIG. 3 is a representation of the method for an improved photomultiplier tube.

Referring to FIG. 3, the method of the improved photomultiplier tube first calls for an impressing 20 of a constant and stable potential across the anode at the dynode nearest the anode irrespective of changing light intensities. This step of impressing includes the coupling 21 of a zener diode and a voltage source across the anode and the dynode nearest the anode to assure wide dynamic range operating characteristics of the improved photomultiplier tube.

Obviously many modifications and variations of the present invention are possible in the light of the above teachings. It is therefore to be understood that within the scope of the appended claims the invention may be practiced otherwise than as specifically described.

What is claimed is:

1. In a photomultiplier tube having a cathode, dynodes and anode disposed in an envelope in a mutually spaced relationship, an improvement for increasing the linear dynamic range capability comprising:

means coupled between the anode and the dynode nearest the anode for impressing a constant and stable collection potential thereacross.

2. An improved photomultiplier tube circuit according to claim 1 in which the constant and stable collection potential impressing means is a zener diode coupled across a voltage source.

3. An improved photomultiplier tube according to claim 2 in which the voltage source is separate from a source providing a dynode potential connected across the other dynodes and the cathode.

4. An improved photomultiplier tube according to claim 3 in which the voltage source includes a serially connected resistor between the voltage source and the zener diode to provide anode current for the photomultiplier tube.

5. An improved photomultiplier tube according to claim 1 in which the constant and stable collection potential means is a fixed voltage source coupled across the anode and the dynode nearest the anode.

6. A method for increasing the linear dynamic range capability of a photomultiplier tube having a cathode, dynodes and an anode disposed in an envelope in a mutually spaced relationship comprising:

impressing a constant and stable potential across the anode and the dynode nearest the anode irrespective of changing impinging light intensities.

7. A method according to claim 6 in which the step of impressing includes coupling a zener diode and a voltage source across the anode and the dynode nearest the anode.

8. A method according to claim 7 in which the step of coupling includes the separating of the voltage source from a source providing a dynode potential coupled across the other dynodes and the cathode.

9. A method according to claim 8 in which the step of coupling includes the connecting of a resistor in series with the voltage source between the voltage source and the zener diode to provide anode current for the photomultiplier tube.

10. A method according to claim 6 in which the step of impressing includes interconnecting a fixed voltage source across the anode and the dynode nearest the anode.

* * * * *